US007756275B2

(12) United States Patent
Crundwell et al.

(10) Patent No.: US 7,756,275 B2
(45) Date of Patent: Jul. 13, 2010

(54) DYNAMICALLY CONTROLLED DIGITAL AUDIO SIGNAL PROCESSOR

(75) Inventors: Duncan J. Crundwell, Alexandria, VA (US); David P. Haydon, Herts (GB)

(73) Assignee: 1602 Group LLC, Alexandria, VA (US)

( * ) Notice: Subject to any disclaimer, the term of this patent is extended or adjusted under 35 U.S.C. 154(b) by 1170 days.

(21) Appl. No.: 11/228,016

(22) Filed: Sep. 16, 2005

(65) Prior Publication Data

US 2006/0083383 A1 Apr. 20, 2006

Related U.S. Application Data

(60) Provisional application No. 60/610,197, filed on Sep. 16, 2004.

(51) Int. Cl.
*H04R 29/00* (2006.01)
*H04R 5/00* (2006.01)

(52) U.S. Cl. ..... 381/59; 381/18; 381/27; 381/61; 381/303; 381/306; 381/307

(58) Field of Classification Search ..... 381/18, 381/310, 17, 59, 27, 61, 303, 306, 307
See application file for complete search history.

(56) References Cited

U.S. PATENT DOCUMENTS 4,251,688 A * 2/1981 Furner ..... 381/18

* cited by examiner

*Primary Examiner*—Vivian Chin
*Assistant Examiner*—Paul Kim

(57) ABSTRACT

A system and method for processing multiple channel audio signals to create a realistic soundscape in a space largely independent of the number of loudspeakers and audio source channels is provided. The system includes an encoding system in the recording process and a decoding system in the local listening area.

1 Claim, 17 Drawing Sheets

DYNAMICALLY CONTROLLED DIGITAL AUDIO SIGNAL PROCESSOR

CLAIM OF PRIORITY UNDER 35 U.S.C. §119

The present Application for Patent claims priority to Provisional Application No. 60/610,197 entitled "Dynamically Controlled Digital Audio Signal Processor" filed Sep. 16, 2004, which is expressly incorporated by reference herein.

BACKGROUND OF THE INVENTION

Portions of the disclosure of this patent document may contain material that is subject to copyright protection. The copyright owner has no objection to the facsimile production by anyone of the patent document or the patent disclosure as it appears in the Patent and Trademark Office file or records, but otherwise reserves all copyright rights whatsoever.

1. Field of the Invention

The present invention relates to multi-channel audio reproduction, and more particularly, to the control of audio images in a listening space.

2. Related Art

Reproducing the sound we hear in life is split into two related challenges, namely fidelity and position. Over the past 100 years the fidelity of reproduced sound has improved considerably but only recently with the introduction of multi-channel digital audio storage devices such as DVD and digital hard drive recorders has it been possible to play multiple channels of audio in a wide variety of venues.

The number of channels of recorded audio is controlled by the recording format but unfortunately as the work of Haas and others show each point source in a space is identified as such by the human brain and so an immersive realistic sound is not created. The precedence effect, in which the human brain localizes to the first sound heard of a sample, forces the image to the audio source closest to the listener. The area equidistant from the loudspeakers is often called the sweet spot and is regarded as the optimum listening position but is unfortunately small, often limited to one or two listeners.

To create the illusion of movement of sound in a listening space or venue, traditionally engineers have used pan pots to gradually lower the sound level in one loudspeaker and simultaneously gradually raise it in another in a process known as panning. However, outside the sweet spot this does not create a realistic illusion of movement due to the precedence effect.

The following references have made contributions in the technology. U.S. Pat. No. 6,663,648 to Bauck, which proposes solutions to the small sweet spot by physical modifications to loudspeakers to move the high frequency drivers closer to the center. U.S. Pat. No. 6,307,941 to Tanner, Jr. et al. proposes and sweet spot enhancing solution for static situations using time delay processors and filtering techniques. Also, in Australian Patent Application No. PQ9424, McGrath et al. provides a loudspeaker system for audio-visual production with delays for loudspeakers is described.

Reproduction of multi-channel sound in the cinema is well established in the art, with noted format standards including Dolby.RTM,™ DTS™ and ProLogic™ formats, to name a few. The most common standard for Surround Sound is 5.1 whereby the audio signals are stored as left, center, right, surround left and surround right. There are also adaptations of the foregoing to include one rear channel in 6.1 and two rear channels in 7.1 formats. In these systems, the "0.1" channel is defined as low frequency channels, used for certain special effects, and is in mono as such frequencies are not processed by the human brain with any significant positional information. The 5.1 audio format is often misunderstood as a listening environment, whereas in actually it is a recording and storage medium. Also, suggestions have been put forward for a 10.2 system, which effectively doubles the number of channels.

Helmut Haas, in a doctoral dissertation to the University of Gottingen, Germany as "Uber den Einfluss eines Einfachechos auf die Horsamkeit von Sprache;" discloses what has become called the "Hass effect" or "precedence effect," notably that in the frequency range 500 Hz to 2000 Hz, the time differences between identical sounds arriving at human ears will be dominant in deciding the origin of that sound. In summary, Haas defines the precedence effect to mean that when multiple identical sounds arrive at a listener, but at different times, the position information of the first sound takes precedence over the later arrivals of the same sound. This effect occurs up to the onset of echo perception, at approximately 40 milliseconds.

Existing solutions generally require a direct relationship between the number of recorded channels in the media and the number of speakers. In a multi-seat room such as a cinema, the listening experience is different for each seat because of the proximity of the loudspeakers and the precedence effect described above. Referring to FIG. 13, a listener 900 respectively hears feed signal 910 from Ls speaker 902, 912 from L speaker 302, 914 from C speaker 908, 916 from R speaker 302, 920 from Rs speaker 906, 1308 from Rb speaker 1304, and 1302 from Lb speaker 1302. FIG. 14 illustrates the same signals in relation to a listener in a movie theatre. From the seating position of listener 900 in a small space in FIG. 13, the same effects are observed as in the movie theatre space of FIG. 14, except that the loudspeakers in FIG. 14 are further apart. Noticeable gaps in the sound image between the loudspeakers shown have been demonstrated to make the effect less realistic.

Adding more loudspeakers 902, 906 in parallel, as shown in FIG. 15, provides greater coverage, but creates multiple sound sources. The multiple sound sources cause a confusing sound field due to multiple sound arrivals from the different sound paths having the same program material. The system depicted in FIG. 14 is in common use in cinemas at present.

As shown in FIG. 16, electronic delays 1602, 1604, 1606, 1608 can be inserted into the loudspeaker feeds. However, the illustrated structure only works for a small area in the center of the room as shown. For a listener located in the left for the room, for example, the delay patterns vary from the ideal situation of FIG. 16, and the image may be lost.

What is needed is the ability to overcome the foregoing problems to provide a realistic listening experience for surround sound, to widen the sweet spot listening area to encompass the majority of the audience in public auditorium, to add realistically moving sound effects, and to enable providing of recording and delivery formats independent of each other.

SUMMARY

To address one or more of the drawbacks of the prior art, the disclosed embodiments provide apparatus, methods and systems for processing multiple channel audio signals to create a realistic soundscape in a space largely independent of the number of loudspeakers and audio source channels is provided. The system includes an encoding system in the recording process and a decoding system in the local listening area.

Still other advantages of the embodiments will become readily apparent to those skilled in the art from the following detailed description, wherein the preferred embodiments are shown and described, simply by way of illustration of the best mode contemplated of carrying out the invention. As will be realized, the invention is capable of other and different embodiments, and its several details are capable of modifications in various obvious respects, all without departing from the invention.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements. The left most digits in the corresponding reference number indicate the drawing in which an element first appears.

DESCRIPTION OF THE PREFERRED EMBODIMENTS

Figure 1:
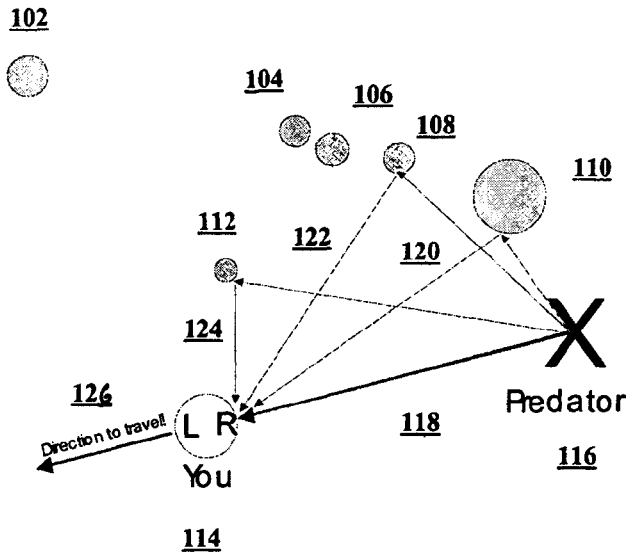
FIG. 1 illustrates sound relationships corresponding to precedent arrival.

While specific exemplary examples, environments and embodiments are discussed below, it should be understood that this is done for illustration purposes only. A person skilled in the relevant art will recognize that other components and configurations can be used without parting from the spirit and scope of the invention. In fact, after reading the following description, it will become apparent to a person skilled in the relevant art how to implement the invention in alternative examples, environments and embodiments.

Recent innovations in sound design make use of surround sound. Surround sound refers to using multiple audio tracks to make the sounds emanating from a theatre sound system appear more life-like. The soundtrack of a surround sound movie soundtrack allows the audience to hear sounds coming from all around them, and contributes to "suspended disbelief," meaning when the audience member is captivated by the movie experience, and possibly not aware of real-world surroundings.

Surround sound formats can rely on dedicated speakers that surround the audience. For example, there is one center speaker carrying most of the dialog, because actors typically speak during their on-screen appearances. There are left and right front speakers which can carry a substantial part of the soundtrack, including musical and other sound effects, and that may also include some dialog if it is desired to intentionally off-set the dialog source from either side of the screen. In addition, surround sound speakers may be included on the respective sides, and slightly above, the audience members, to provide ambient effects and surrounding sounds. Also, a subwoofer can be employed for low and very low frequency effects that are sometimes included.

A number of formats used for surround sound systems. One example is Dolby Digital,™ considered a de facto surround sound standard in home theaters, and used in a large number of movie theaters. It is part of the High Definition TV (HDTV) standard, used in pay-per-view movies, digital TV channels of digital satellite broadcasting, and successor to Dolby Surround Pro-Logic.™ The format provides up to five independent channels, namely center, left, right, surround left, and surround right; giving it the "5" designation of full frequency effects in the 20 Hz to 20,000 Hz range, plus an optional sixth channel dedicated for low frequency effects reserved for the subwoofer speaker. The low frequency effects channel gives Dolby Digital the "0.1" designation, which signifies that the sixth channel is not full frequency, as it contains only deep bass frequencies in the 3 Hz to 120 Hz range.

Another format is DTS Digital Surround™ (DTS). It is also another 5.1-channel surround sound format widely available in movie theaters. It is also offered as an optional soundtrack on some DVD-Video movies for home theatres, but is not currently a standard soundtrack format for DVD-Video, and is not used by HDTV or digital satellite broadcasting. A primary benefit of DTS is its offering of higher data rates than Dolby Digital, but has the disadvantage of using greater disc data capacity.

Yet another format is Dolby Surround Pro-Logic,™ which has become the surround sound standard for Hi-Fi VHS, and still the standard for analog TV broadcasts, because the signal can be encoded in a stereo analog signal.

There are also extended surround formats, including Dolby Digital EX™, THX Surround EX™ and DTS Extended Surround™ (DTS-ES™). For example, THX Surround EX™, developed jointly by Lucasfilm THX and Dolby Laboratories, is the home theater version of "Dolby Digital Surround EX™", which is the Extended Surround sound format for current state-of-the-art movie theaters.

Delay imaging is an important component of real-life surround sound. The roots of delay imaging lie in what is known as the Precedence Effect, sometimes known as the Haas Effect, after Helmut Haas who researched into speech intelligibility in the 1940's. Helmut Haas's doctoral dissertation was presented to the University of Gottingen, Germany as "Über den Einfluss eines Einfachechos auf die Hörsamkeit von Sprache."

According to the theory behind the Precedence Effect, human beings do not hear everything in the way that it actually occurs in the real-world. The human brain processes the sound to improve intelligibility. For personal survival, the original direction of the sound sample is of paramount importance to the individual.

Taking the example of an individual in the wild, the warning of danger is likely to come from a predator cracking a stick, by for example stepping upon it, as it approaches the individual. The next reaction of the individual can be critical to the individual's survival. The first sound arrives at the human right ear directly from the sound source. This is closely followed by reflected sounds from the trees in front of the individual.

Referring to FIG. 1, an individual 114 is pursued by a predator 116. The desired direction of travel would be direction 126 away from predator 116. A number of objects 102-112 are also illustrated. The original sound 118 travels to the individual 114 directly, as opposed to sounds 120-122 which echo off of objects 108, 110 and 112.

Although the secondary arrivals of sounds or echoes 120-124 of a short delay can enhance the intelligibility of the sound, the positional information of predator 116 is retained from the original sound 118. The arrival of this is sound 118, that precedes the other sounds 120-124, is referred to as Precedent Arrival, and therefore the effect is known as the Precedence Effect.

In FIG. 1, the first sound heard comes directly from the twig snapping. Positional information is calculated by the arrival time difference between the left and right ears of individual 114. The subsequent sounds 120-124 are used to enhance the original sound, and are not heard as individual sounds until they become an echo. The step of calculating the source of the original sound is referred to as localization.

A person can identify the localization of a precedent sound even if it arrives as little as 1 millisecond earlier than its echo. However, time delays of small amounts will interact with each other at frequencies that can be heard. A 1 ms echo of a 500 Hz signal can cause the sound to completely cancel if the amplitudes of the original sound and the echo are equal.

Echoes causing cancellation in the audio bandwidth are known as phasing or comb filtering. Echoes in excess of 10 ms will not cause audible phasing with speech or other non-periodic sounds. This is because the fundamental cancellation frequency is below normal hearing bandwidth and cancellation at related harmonic frequencies is unlikely to occur.

The precedence effect will continue to be heard until the echo becomes perceived as an independent sound. This point, around 30 ms, is known as the threshold of echo perception. This time window, between 10 and 30 ms, is referred to herein as the Haas Window.

Figure 2:
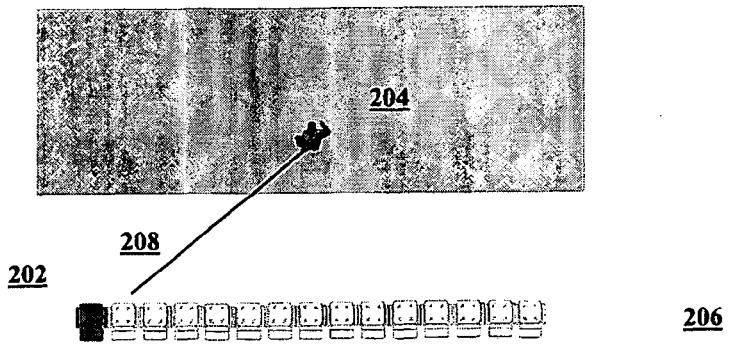
FIG. 2 illustrates sound signals received by a listener from a performer in a front seat at a concert hall.

Beginning with FIG. 2, the figure depicts the front row of seats 206 in a concert hall with a single performer on stage 204. The listener 202 is located on the left of the row of seats 206. The soloist 204 has no speaker system, so listener 202 in the front row 206 on the extreme left seat is going to hear the soloist from exactly where the soloist is located. The shortest path 208 is the most direct one and takes precedence over any possible delayed paths. The brain of the listener 202 localizes the sound to the performer.

Figure 3:
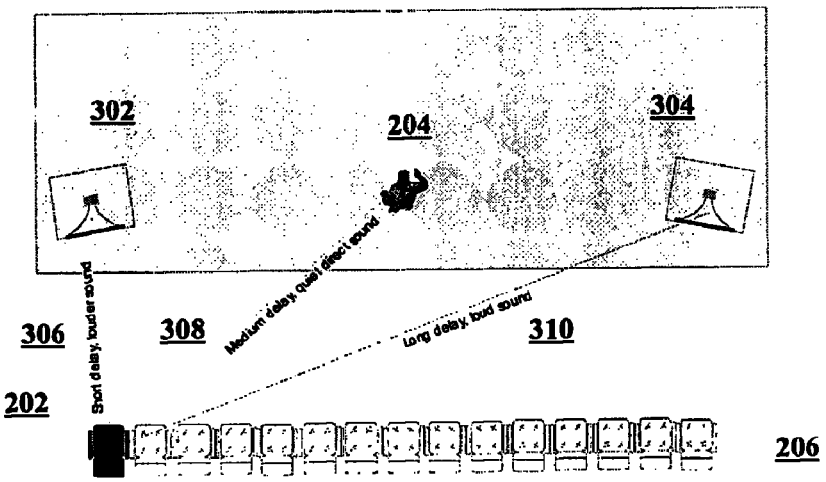
FIG. 3 illustrates sound signals received by a listener from a performer and speakers in a front seat at a concert hall.

Next, in FIG. 3, two speakers, namely left speaker 302 and right speaker 304 are added, to reproduce the sound of the performer 204. Now the closest source of the sound is the left speaker 302, namely sound 306. The right speaker 304 provides a sound 310 that arrives after sound 308 from performer 204. The listener 202 is now confused because the visual and the audio information are conflicting. This can be corrected using time delays to the speakers so that the original source of the sound 308 takes precedence. This is referred to as source oriented reinforcement. As the name describes, source oriented reinforcement (SOR) concentrates on the original source of the sound 308. This source could be a live performer's voice or an instrument, or indeed anything where the sound stimulus needs to be realigned with the visuals.

Figure 4:
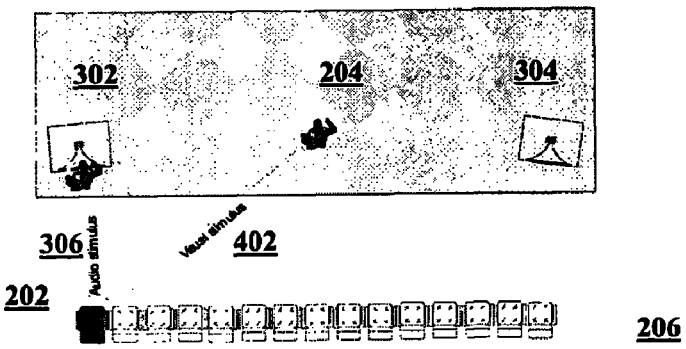
FIG. 4 illustrates a conflict scenario between a visual stimulus and an auditory stimulus.

FIG. 4 illustrates that the visual stimulus 402 of the performer 204 is different from the auditory stimulus 306 having precedent effect. The mind of the listener 202 is confused by the inconsistency, and the auditory stimulus is not perceived as particularly life-like.

A simple demonstration of the power of delay and hence the importance of SOR is listening to the "sweet spot, where the sound from the speakers travels equal distances, and appears to the listener 202 as if it is coming from performer 204. In an average living room set-up the "sweet spot" could be as small as a few inches wide.

Moving to the left from the center position rapidly shifts the image to the left speaker only, as the precedence effect takes over. Correcting the offset with the balance control is difficult, if not impossible, as the law of precedence takes control, not the relative levels. However introducing a small delay to compensate for the signal path difference can correct the problem.

By implementing a SOR system, the desired even distribution of sound level is achieved over a large listening area. It will also maintain directional information about multiple sound sources. Here, the "audio position" of a presenter, actor, musical instrument, recorded program channel or special effect authentically matches the actual "visual position" or required contextual localization.

The delay is increased to ensure that direct sound arrives first. This outcome reduces listener's stress. It also improves intelligibility and the message impact for all audience members. According to the disclosed embodiments, the "sweet spot" is widened for creative, panoramic or spatial information in the sound mix to a great majority of the audience listening positions.

Figure 5:
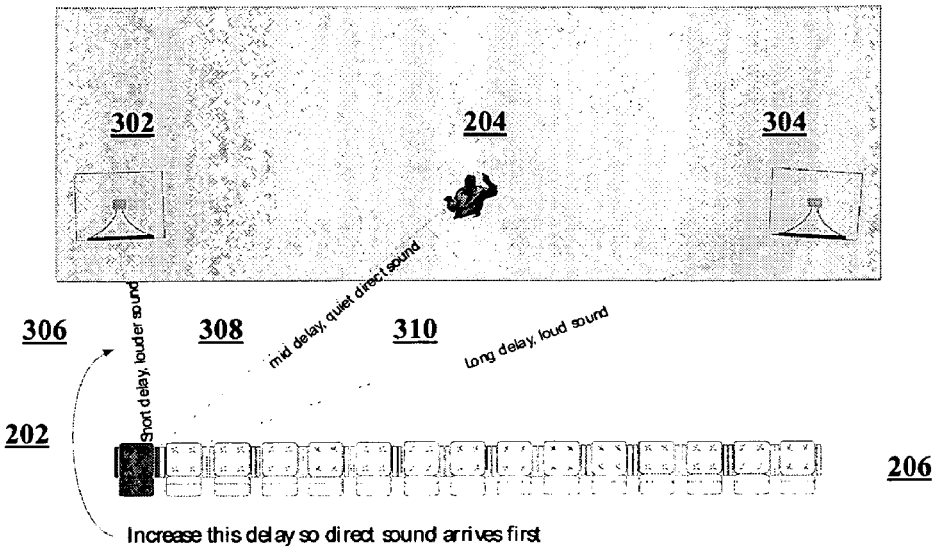
FIG. 5 illustrates time delays used to restore precedence through source oriented reinforcement

Referring to FIG. 5, again three sound sources are provided, namely sound 306 from left speaker 302, sound 310 from right speaker 304, and the performer's voice direct 308 from the performer 204. As SOR is dealt with, the first step is to establish the time relationship between the performer and the listener. Measuring the direct distance at 50 feet and based on the assumption that sound travels at approximately 1 ms per foot in air, it can be estimated that the time difference to be 50 ms. The left speaker 302 is closer, only 30 feet away, and so the time delay is 30 ms to the listener 202, sitting in the front left row seat.

To prevent the left speaker 302 taking precedence over the performer 204, it is necessary to delay the feed by (50−30) =20 ms. This is the difference in time between the two sources. However, remembering the Haas window of 10-30 ms means that over-delaying by another 10 ms must be performed. This will avoid comb filtering. The total delay for the feed to the left speaker is 20+10=30 ms. Accordingly, the left speaker is delayed with a feed of the performer by 30 ms. The Precedence Effect will cause the listener to believe that the sound is all coming from the performer.

However, there are limits to this practice. For example, a very large speaker system will create too great a difference and the performer's original voice 308 will be lost as an image. In this case, a center speaker may need to be used as a reference to lock the SOR.

It is also possible that a listener 202 will move to another seat. As the listener 202 moves toward the center, the actual delay of the left speaker 302 will increase as the distance from the speaker increases. The delay from the performer reduces and the image remains fixed on the performer.

As illustrated, a right speaker 304 is included, providing additional acoustical effects. If the listener 202 moves to the right seat on the front row the exact same set of problems occur, as we experienced with the Left speaker. As the stage is symmetrical, the figures for the delay are the same. Delaying the signal to the right speaker 304 by 30 ms will bring the image back to the performer for a listener 202 in the front right seat.

A listener 202 in the front row in the center is going to hear the performer 204 first, as this is the closest sound source, with the feed to both speakers being delayed. As a result, the listener 202 will hear the correct image.

Suppose the listener 202 stands up, during the performance, and moves to the right of the row 206. As listener 202 moves toward the right, the delay increases to the performer 204 and reduces to the right speaker 304. However, because the right speaker 304 has been localized to the performer for the worst position, which is the seat closest to the speaker, the sound will continue to come from the performer.

Figure 6:
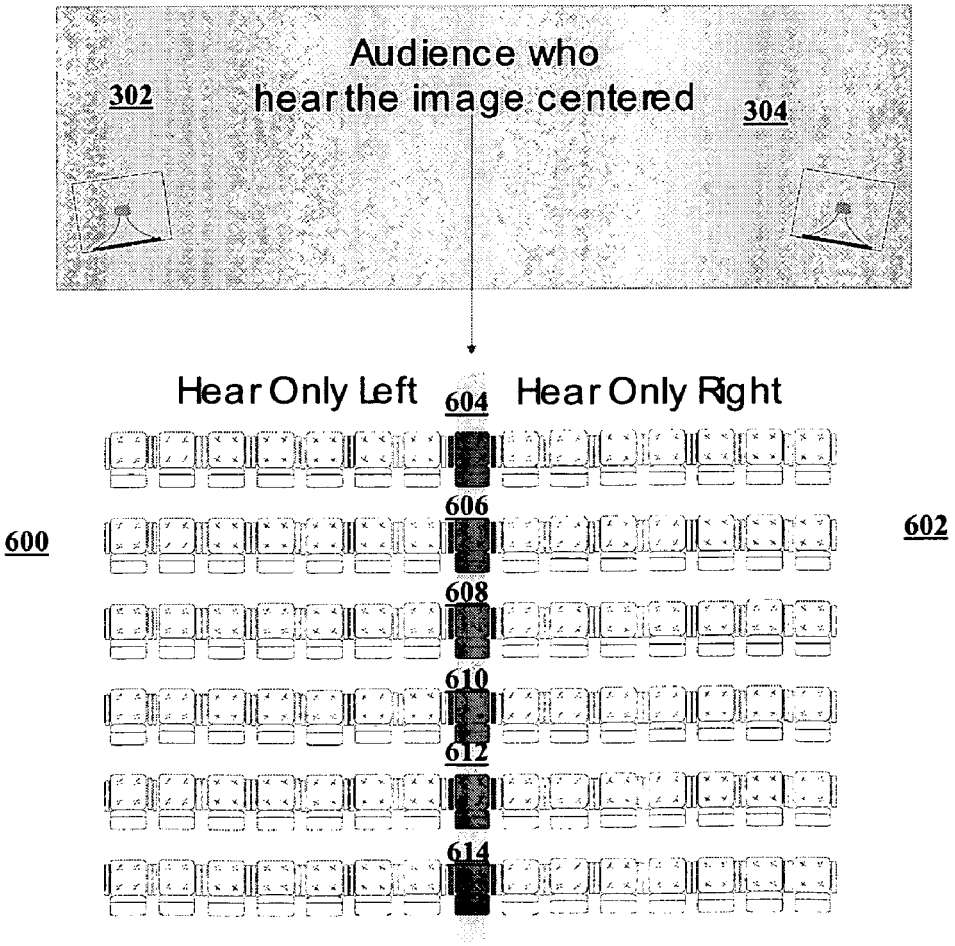
FIG. 6 illustrates a demonstration of delay panning.

FIG. 6 provides a simple demonstration of delay panning. Here, a sound source is taken, and panned dead center on the PA system, by left speaker 302 and right speaker 304. A surprisingly small number of the audience members, namely members 604-614, will hear the sound in the center. In this embodiment, precedence takes effect and localizes the sound to the nearest source.

Figure 7:
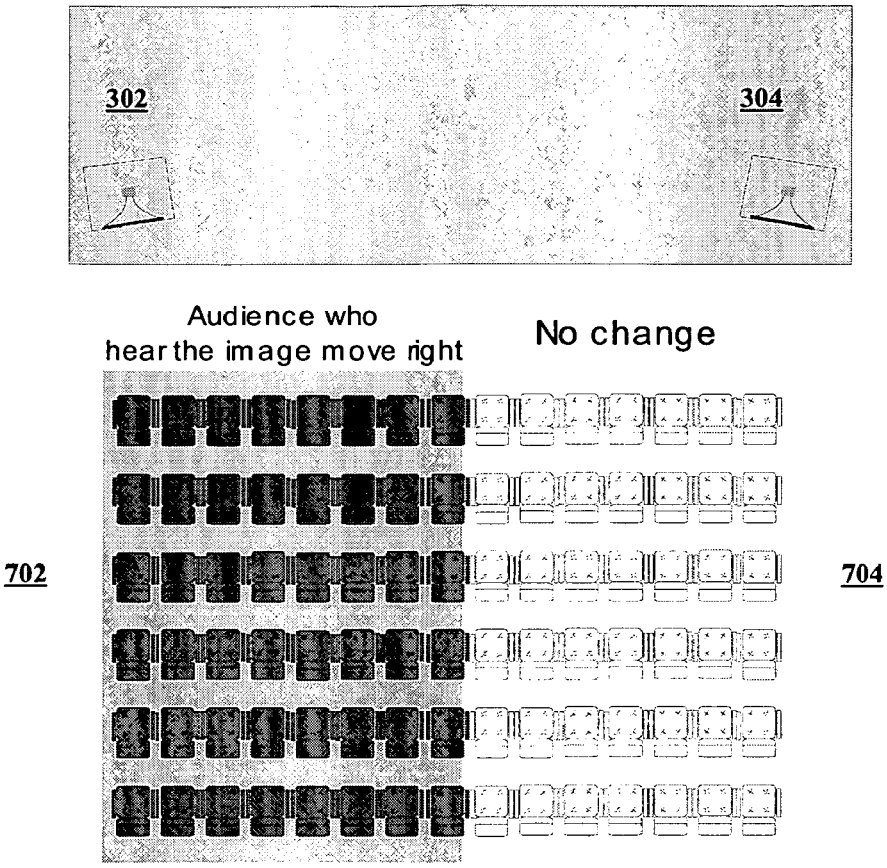
FIG. 7 illustrates an example of the effect of delay panning on listeners.

Referring to FIG. 7, the feed to the left speaker 302 is fed through a delay, which gradually increased from zero to 50 ms. If the audience is asked to indicate if the sound moved or not, the image moves to the right for everyone 702 who either heard it centered or on the left when the delay is increased to the left speaker 302, but has no change for audience members 704. This demonstrating that delay panning is a far more effective tool than level panning.

The foregoing principles of the present embodiments apply to multi channel systems. Though more difficult to visualize, the same effect occurs in multiple paths. It should be noted that localizing is being done to sources, not solving speaker issues.

Figure 8:
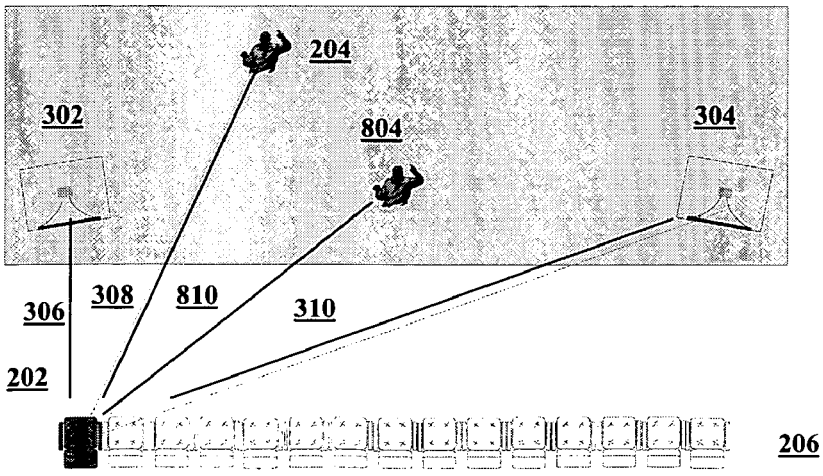
FIG. 8 illustrates sound signals received by a listener from two performers and speakers in a front seat at a concert hall.

FIG. 8 illustrates a stage set-up, this time with two performers 204 and 804, respectively heard as 308 and 810. The speakers, respectively 302, 304, have feeds 306, 310. Because the system is set up for SOR, although the speakers are the same, another source is added. The system must be adjusted to provide a second source in the image. The rules are exactly the same. In this case the second performer 804 is 65 feet from the listener. Therefore the feed to the left speaker 302 must be delayed by: (the distance to the original source−the distance to the speaker)+10 ms over delay, which here is (65−30)+10=45 ms. As this presenter is not central, the right speaker feed 310 will require a longer delay.

Sound in movie theaters advanced rapidly in the 1980's but more recently has seen competition from the home theater DVD market. As noted, the sound image produced by a small number of speakers is limited in size to very small area known as the sweet spot. In a home theater, this is the center seat, usually of three, for the person who paid for the installation. In a movie theater most seats in the room do not receive an adequate sound image related to image on the screen.

Using the embodiments noted above, the precedence effect can be applied to advantage. By feeding a delayed signal of the left into the right, the image can be broadened from the perspective of the auditory signals.

Figure 9:
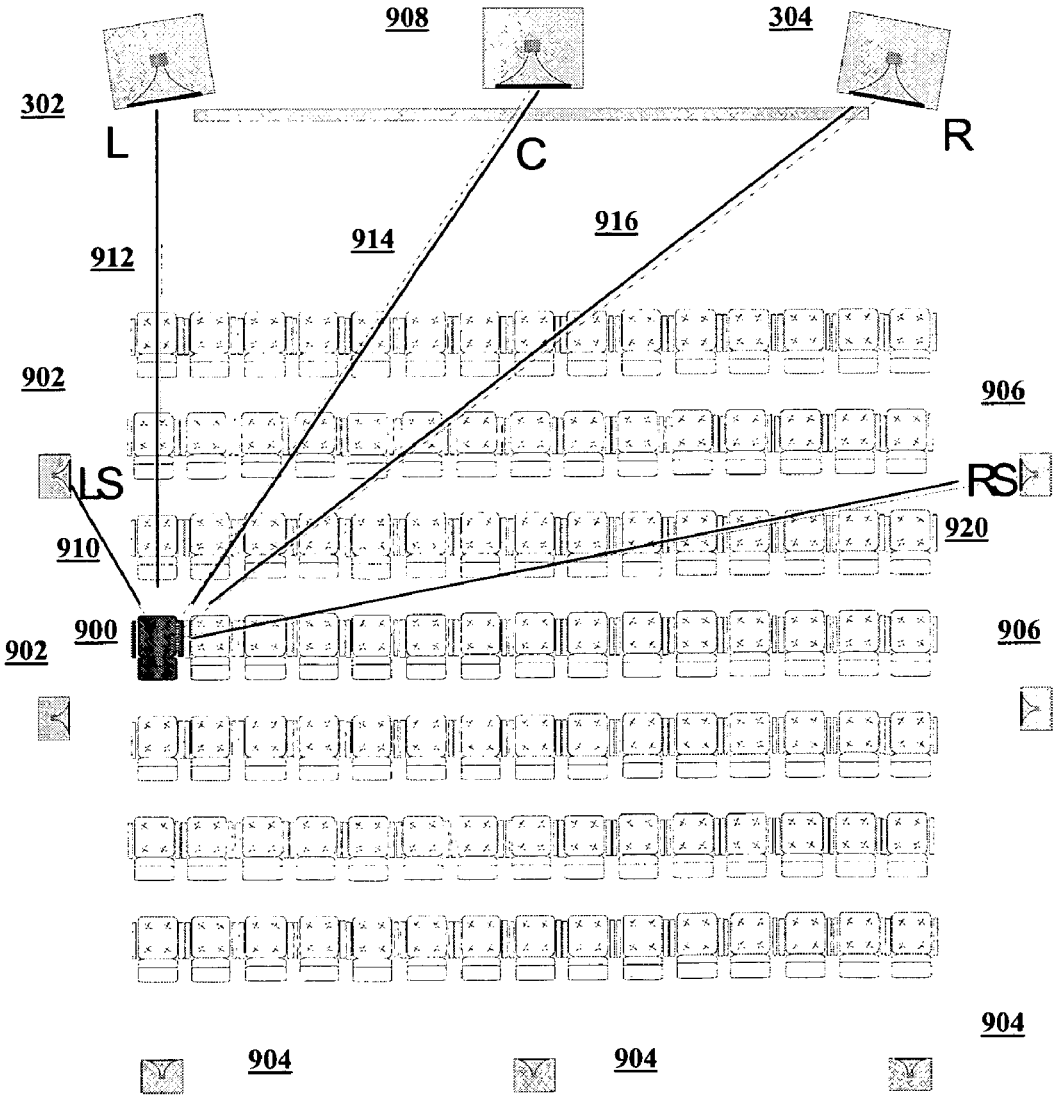
FIG. 9 illustrates sound signal path dispersal in a movie theatre.

Referring to FIG. 9, the signals sources are illustrated for a listener halfway back on the left side. As illustrated, listener 900 receives signals 910 from LS speakers 902, signals 912 from L speaker 302, signals 914 from C speaker 908, signals 916 from R speaker 304, signals 920 from RS speakers 906, as well as signals (not labeled) from rear speakers 904.

As noted, only the signal sources in front of listener 900 are labeled. Though some program material will be heard from these rear speakers 904, the human ear is not tuned to hear sounds from behind, and both positional information and quality from such sources is poor. The information in the front 180 degrees is the most relevant to pinpointing the source and understanding the material.

In this embodiment, a sound image is created that represents the action on the screen. Without time delays, listener 900 will hear all of the music track from the left, dialog from the center if the center is the single source for dialog. Any panned dialog will be mainly left, with surround sound coming from the close left and above listener 900. Also, the sound will appear fragmented and associated with individual speakers.

In the present embodiments, a delayed cross matrix can be created to restore the auditory features of the image. Dialog, delayed and fed into the L 302 increases intelligibility but is still be anchored to the screen. The SPL is allowed to be reduced at the front of the room. Music will fill the space more evenly as the left speaker will be fed with delayed program from C 908 and R 304. Effects can be made to move realistically within the space for this and most other seating positions. Thus, the experience is more immersive and satisfying for listener 900.

Figure 10:
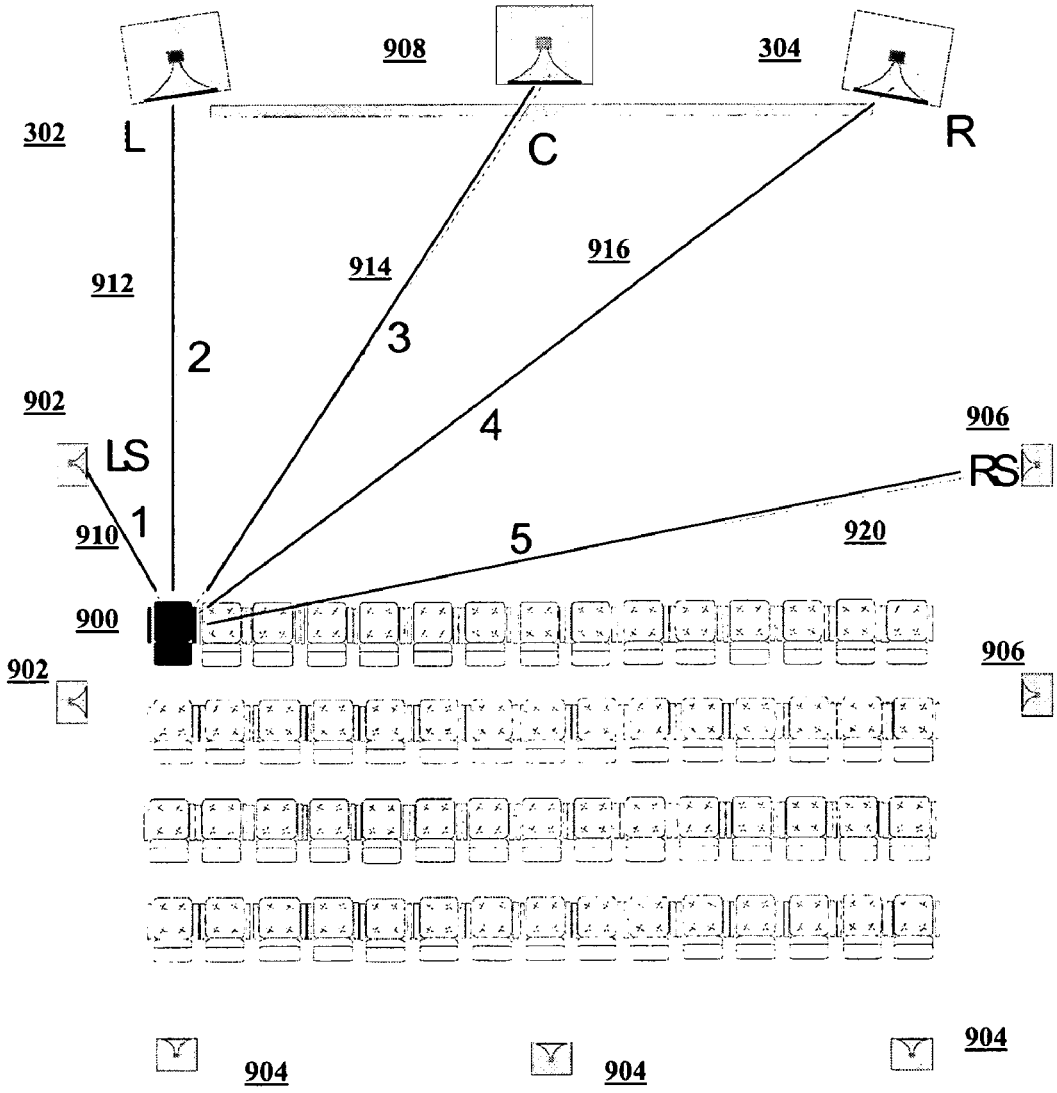
FIG. 10 illustrates how signal paths are calculated in the environment of FIG. 9 in accordance with certain second embodiments of the present invention.

FIG. 10 illustrates the same space with seats positioned ahead of listener 900 removed, to more clearly show the signal paths. The five significant signal paths for this listener are shown and numbered 910, 912, 914, 916 and 920.

Beginning with signal source LS 902, the signal 910 is fed with a mix of the following feeds:

LS+*L(Delay 2−Delay 1+10mS)+*C(Delay 3−Delay 1+10mS)+*R(Delay 4−Delay 1+10mS)+*RS (Delay 5−Delay 1+10mS)

Where * is used to define an attenuated form of the original signal to allow for distance losses and to ensure that the original source is still dominant and hence mask the local source. Delays are related directly to the distance of each source from listener 900 as described above. In this embodiment, 10 milliseconds are added to each delay to remove comb filtering.

This procedure calibrates signal source 910 for the worst condition, which is where a listener 900 is close to the source, here LS 902. Because the room is symmetrical, the same formula will apply for RS 906 but with the sources mirrored as follows.

Figure 11:
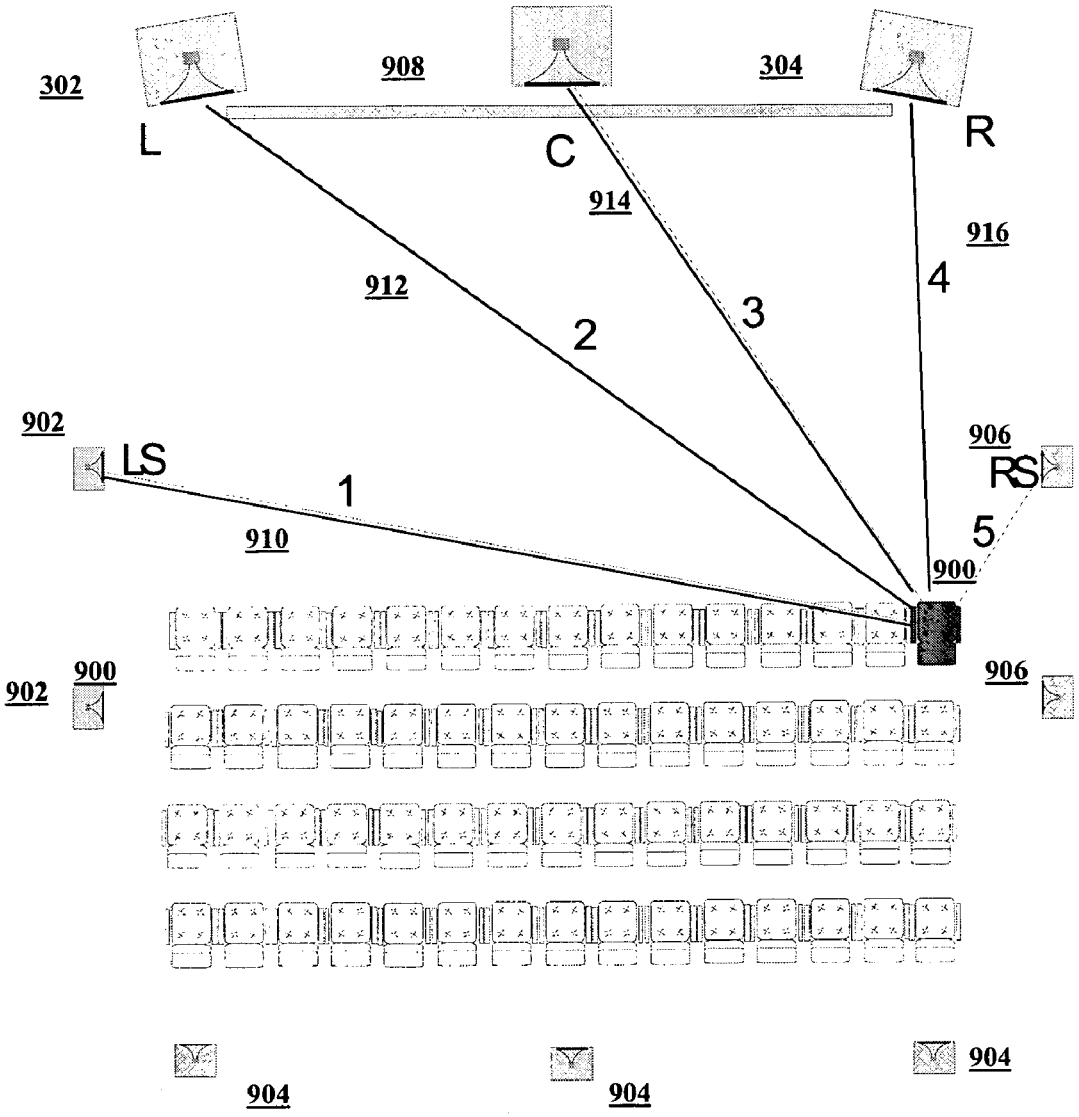
FIG. 11 illustrates how signal paths are calculated in the environment of FIG. 9 in accordance with certain second embodiments of the present invention.

As a second embodiment illustrated in FIG. 11, in reference to listener 900 sitting next to signal source 920, for example, the signal is fed with a mix of the following feeds:

RS+*LS(Delay 1−Delay 5+10mS)+*L(Delay 2−Delay 5+10mS)+*C(Delay 3−Delay 5+10mS)+*R (Delay 4−Delay 5+10mS)

Because the room is symmetrical, in this position Delay 5 equals Delay 1 in the previous example. Also the distances are the same and so the individual * values are also the same. These calculated feeds enable virtual sound positions known as image definitions in a source oriented system. This is important for the audio mix engineer as they become universal reference points which are independent of the room size.

Figure 12:
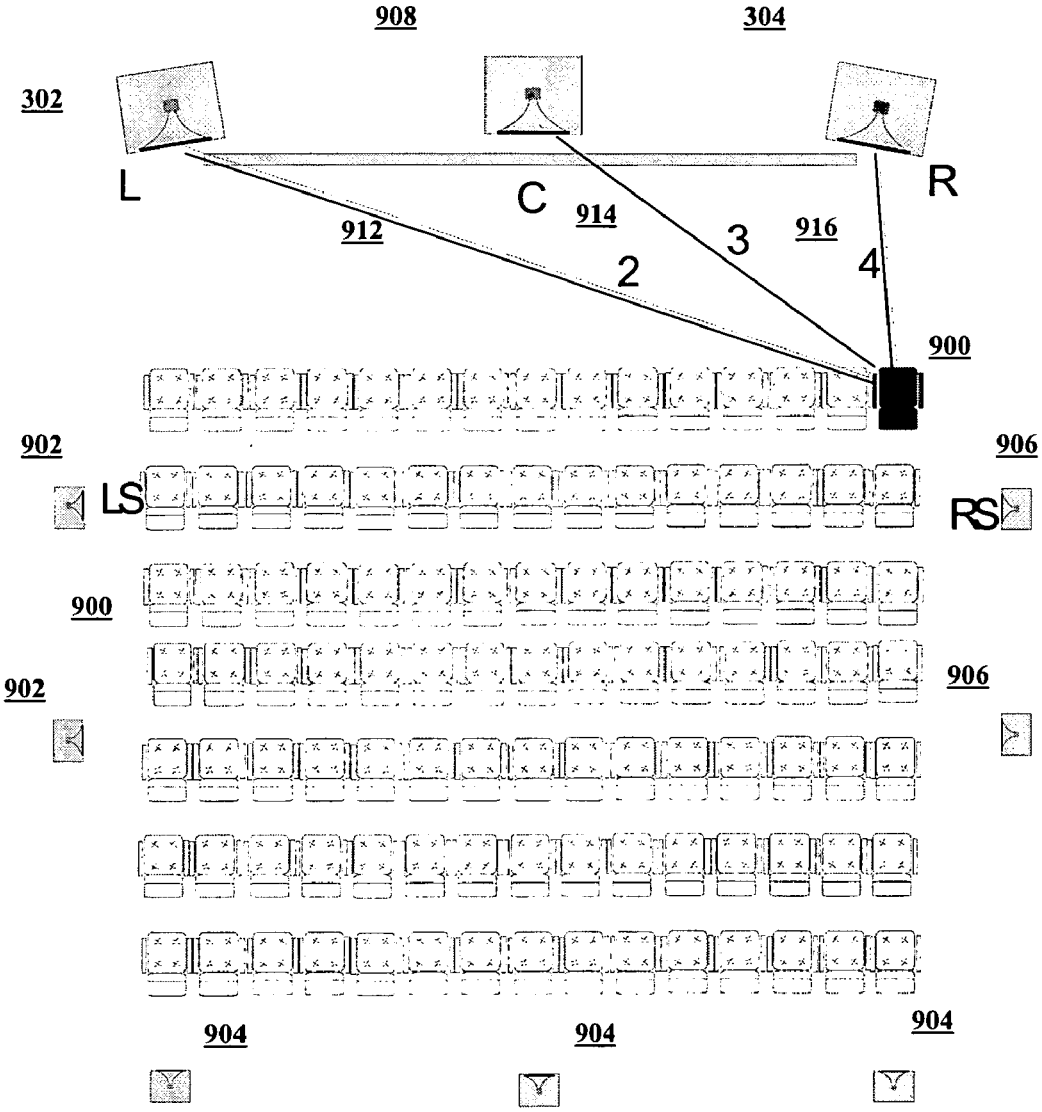
FIG. 12 uses the environment of FIG. 9 to show how image definitions are generated in the context of the present embodiments of the present invention.
Figure 13:
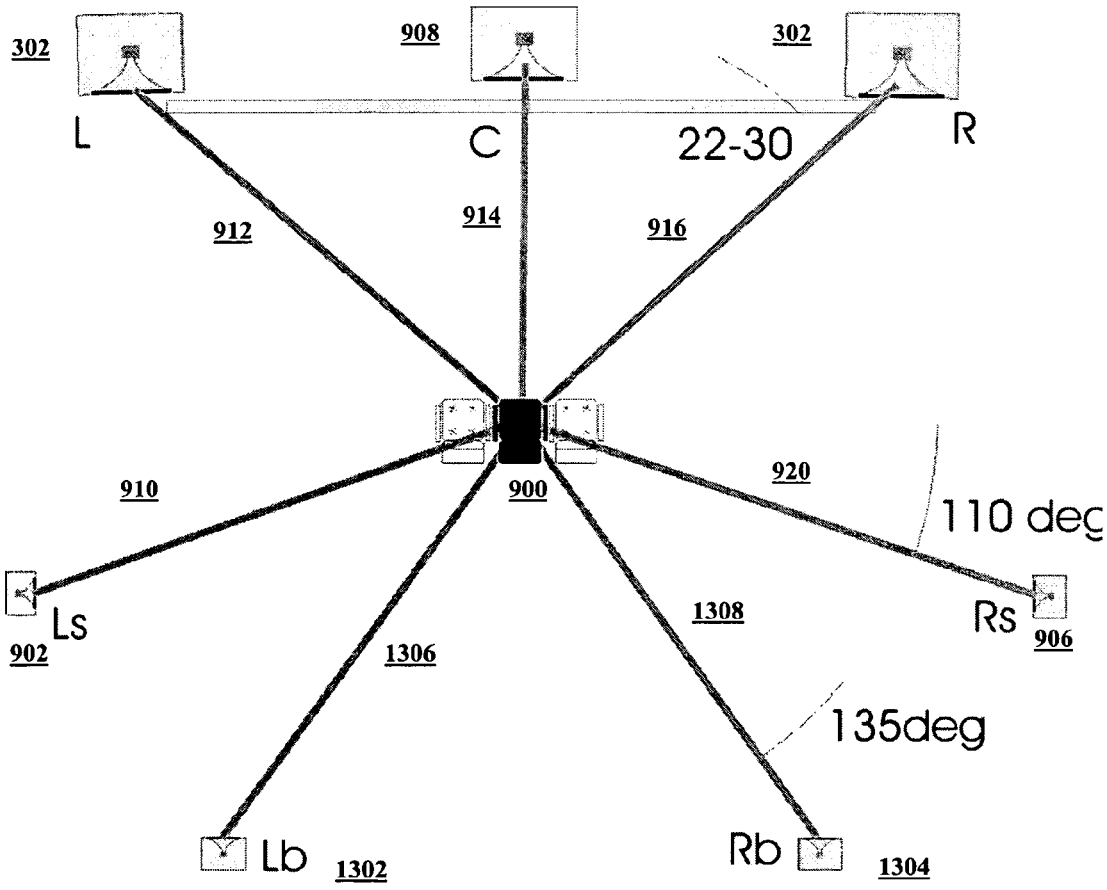
FIG. 13 illustrates a position in relation to speakers.
Figure 14:
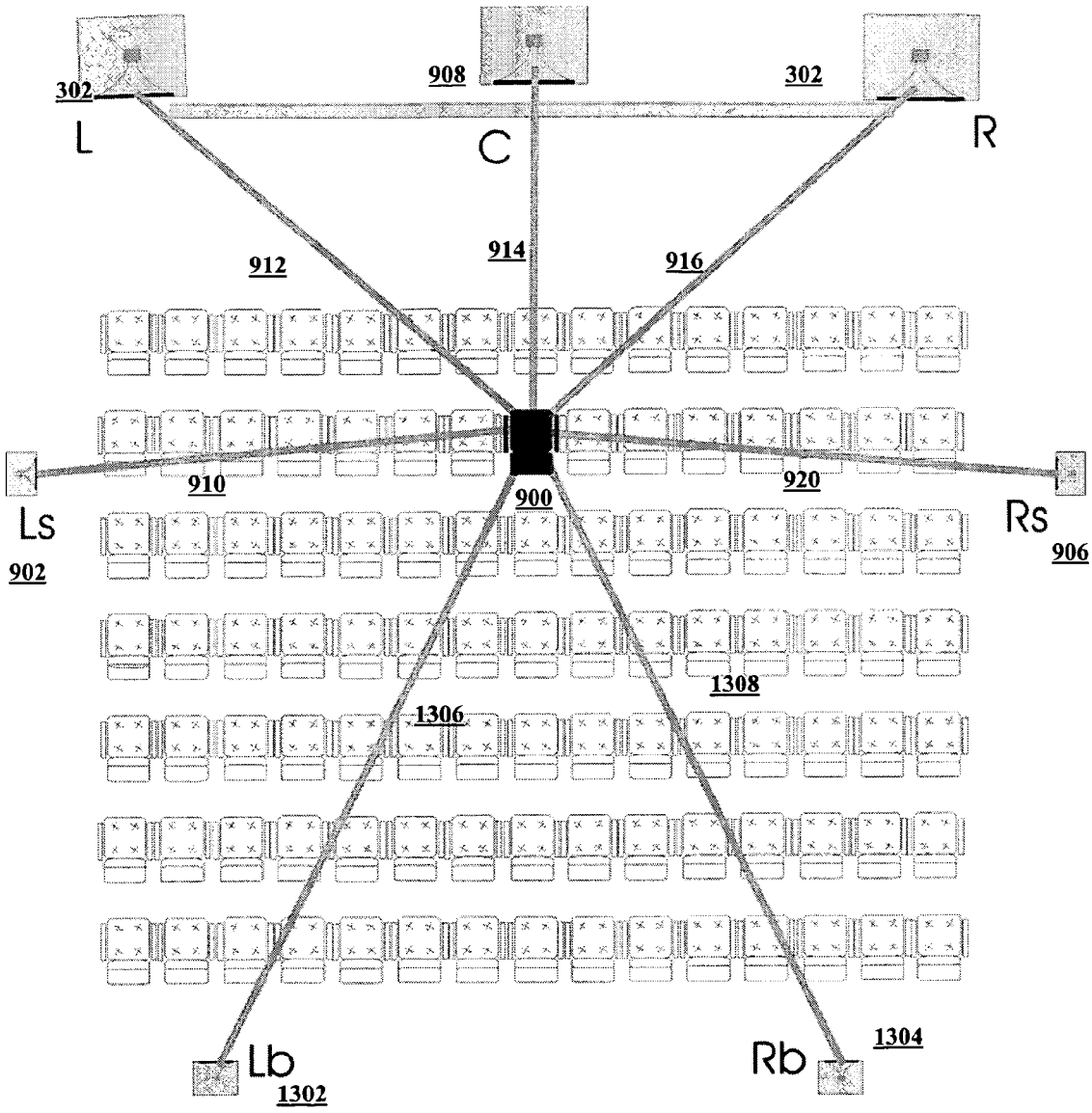
FIG. 14 illustrates the features of FIG. 13 in a movie theatre setting.
Figure 15:
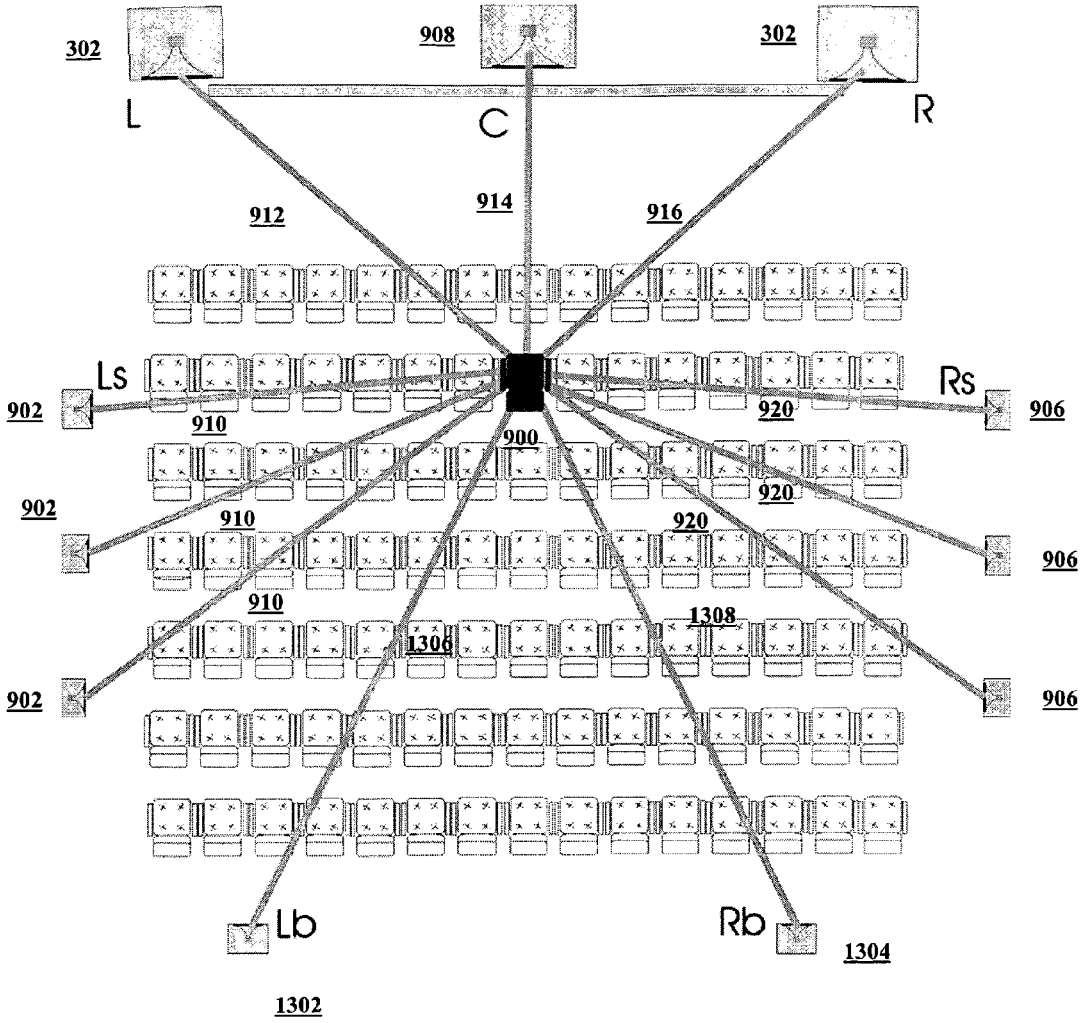
FIG. 15 illustrates the features of FIG. 14 with a greater number of sound sources.
Figure 16:
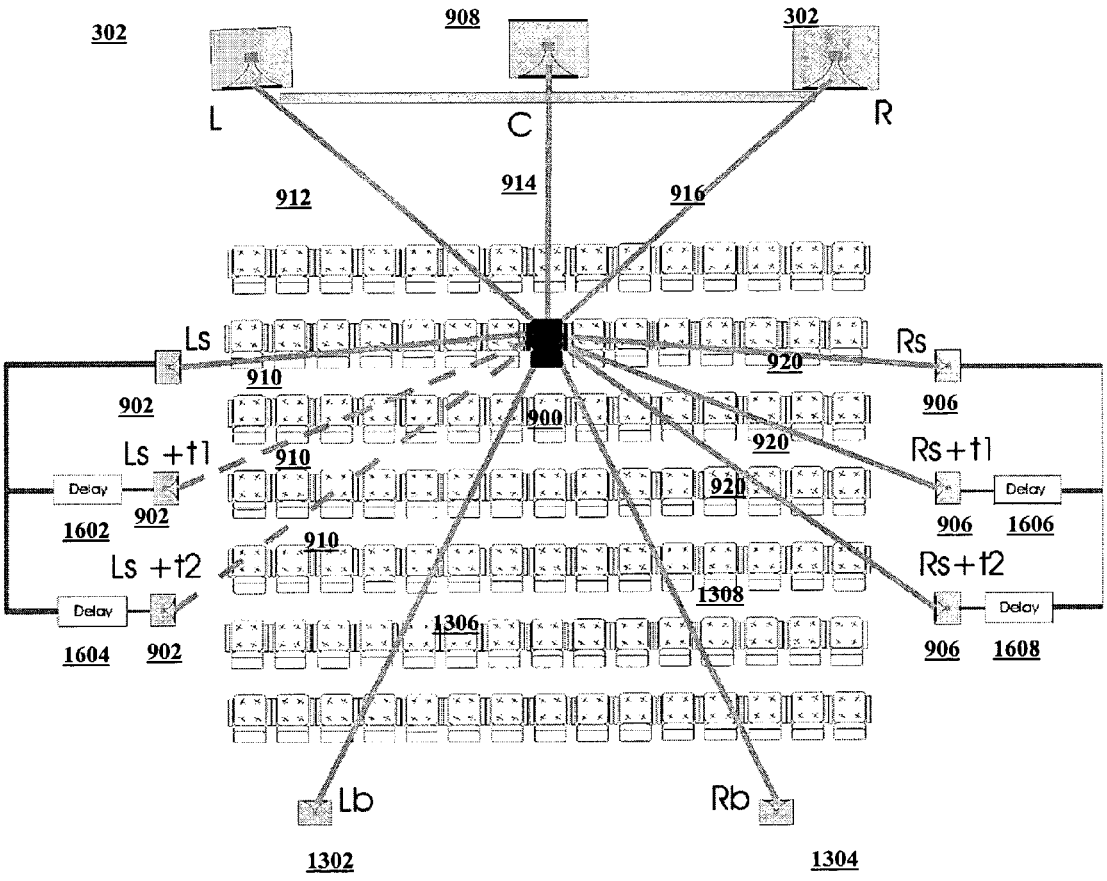
FIG. 16 illustrates the features of FIG. 14 with the insertion of electronic delay elements.

FIG. 12 is used to illustrate image definitions in the context of the present embodiment. The intention of an image definition is to create a position in a room that the audience believes a sound is coming from. An image definition is related to, but independent of, the loudspeaker positioning. In a live show the performers can be image definitions. By defining a performance space using image definitions, the mix can be independent of the room configuration.

A sound engineer can create a stereo music mix for left and right channels. The signal processor in the performance space will use the left and right image definitions to optimize the listening experience for the room based on this instruction. The local set-up will define how much delay and cross feed to the surrounds can be accommodated for the given space using the formulae defined earlier.

Returning to calculation of image definitions, the left image definition can be set for the worst seat for each loudspeaker. For instance, a listener 900 sitting in the front row on the right must not be able to hear sound coming from the front right loudspeaker R 304 even though there is signal present in that loudspeaker.

From the drawing above, the signals for the Right Loudspeaker are:

R+*L(Delay 2−Delay 4+10mS)+*C(Delay 3−Delay 4+10mS)

Similarly the signals for the Center Loudspeaker set for a listener in the worst position are:

C+*L(Delay 2−Delay 3+10mS)+*R(Delay 4−Delay 3+10mS)

The signals for the Left Loudspeaker set for a listener in the worst position are:

L+*C(Delay 3−Delay 2+10mS)+*R(Delay 4−Delay 2+10mS)

In this situation we assume that the left image definition is the same as the left loudspeaker. To test the left image definition using this model, the signals provided in Table 1 are obtained.

TABLE 1

| | |
|---|---|
| Left Front Seat | Left speaker with delayed plus attenuated Center and Right. Precedence effect makes this Solid Left |
| Center Front Seat | Left speaker with distance delay plus attenuated and delayed Center and Right. Precedence effect makes this Solid Left |
| Front Right Seat | Left speaker with distance delay plus attenuated and delayed Center and Right. Precedence effect makes this Solid Left but the SPL is enhanced by the presence of the Right speaker in the delayed feed. |

Accordingly, in the aforementioned scenario, a 3 way matrix is established where each speaker is fed with a combination of level and delay mix from each cross-point in the matrix. The image definitions have been defined to be the same as the loudspeaker positions L 302, C 908, R 304. In other embodiments, the L 302 and R 304 loudspeakers are moved wide of the screen, and then define left and right image definitions to be at the screen edge with additional wide left and wide right for optional effects, if required. In one embodiment, a smaller room where the loudspeakers are at the edges of the screen can have redefined image definitions where outer left and left are in the same place.

Using the image definitions of the present embodiments, the sound sources can be positioned accurately in the performance space for all audience members. Sounds can be panned between image definitions using level panning but it is possible to improve this still further. Also, dynamic effects can be created by moving between image definitions by altering the delay information between image definitions. FIG. 7 shows the power of delay imaging and also the ability to move the image in the space by altering the relative delays and levels.

In the L, C, R model noted above, it is shown that each of the three image definitions are created from a combination of delayed signals from each sound source. If the system receives a signal panned L to C to R, it will respond to such signal and create a level pan. However, the precedence effect will make gaps between the loudspeakers become noticeable as the listener, with "hangs on" to the local source until the level shift overcomes the precedence effect.

A dynamic image can be created by cross-fading between image definitions in a digital signal processing (DSP) matrix. Changing both level and delay to fade between one image definition and another creates smooth and convincing transitions between image definitions and have realistic movement of the image. Changing delay dynamically is a difficult task if distortion and "glitches" are to be avoided but products are currently available, such as the TiMax™ System, which have successfully overcome the foregoing and are in daily use on Broadway shows.

In addition, growing interest in three dimensional (3D) movies increases the need to have believable audio to support the images. The image definitions of the present embodiments work equally well in all three dimensions and can be used to create virtual positions, such as outside the auditorium. For example, a helicopter arriving but not in view will create a sound made up of random long delays caused by reflections off local objects with no direct sound source until it is visible.

The system of the present embodiments comprises of two elements: an encode system and a decode system. The object is to recreate the ideal listening experience depicted in FIG. 1 for a small room so that in a multiple viewer environment the majority of the audience receives the audio image that was intended when the presentation was originally created. The precedence effect described above will cause listeners seated at the edges of the listening area, as for example shown in FIG. 17, to hear a radically different audio image than those seated in the sweet spot.

In an embodiment, a digital signal processor is used to change the audio levels and delays to the loudspeakers in accordance with the aforementioned algorithms so as to widen the sweet spot area. Here, the precedence effect is also used to improve the listening experience by the addition of delays and cross matrixed feeds from other audio channels.

In an embodiment, there is a separation between the number of loudspeaker channels required for playback and the number of channels required for the recording medium. This is achieved by programming virtual room positions into the DSP matrix in accordance with the image definitions. As alluded to, an image definition is a combination of level and delays to the outputs of the DSP matrix, which will represent a desired relative physical position in the image. For example, in an audio-visual presentation screen, left would be an image definition. Image definitions are programmed into the DSP matrix for each physical layout and then used to position the sounds in the audio image.

Figure 18:
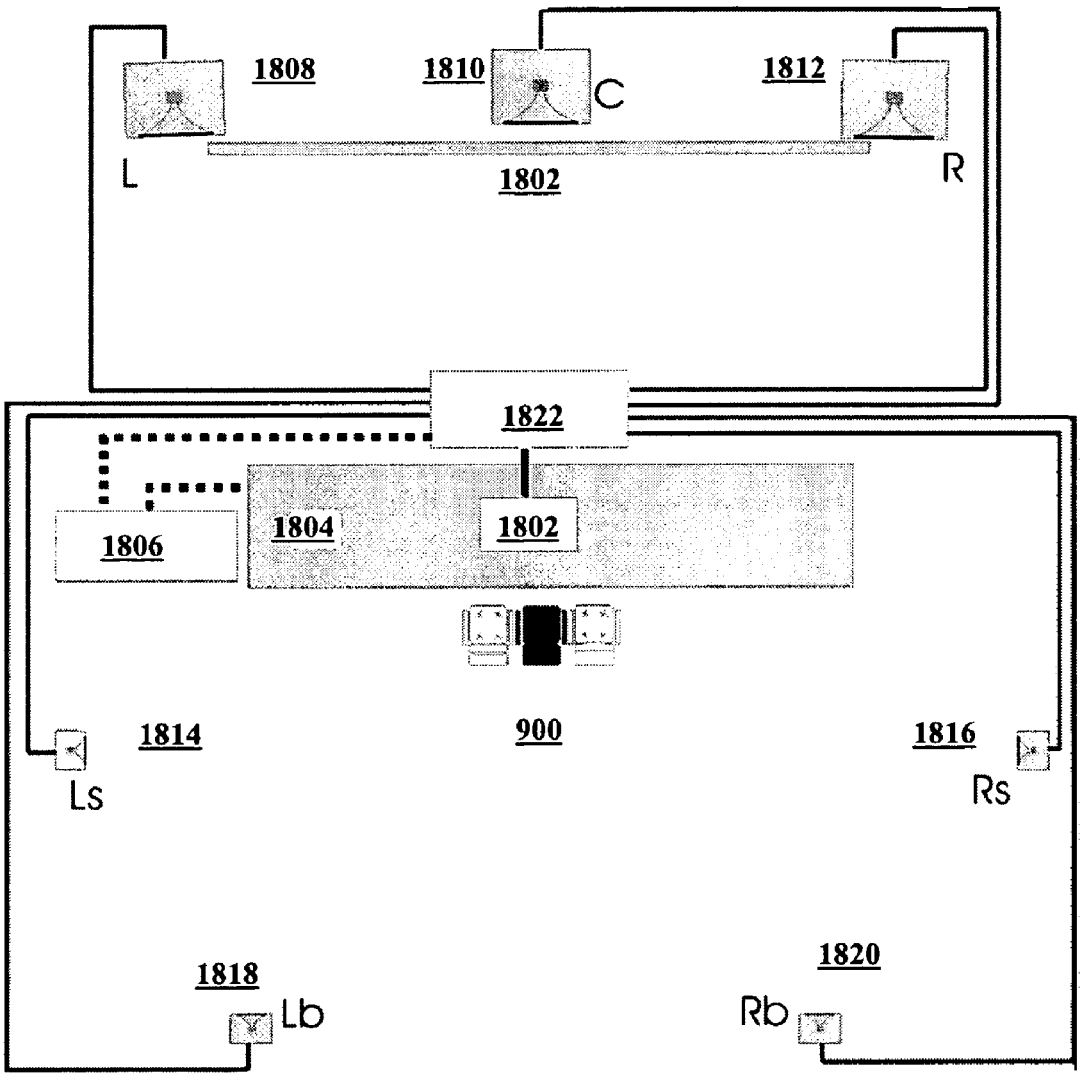
FIG. 18 illustrates a sound recording environment in accordance with certain embodiments of the present invention.

FIG. 18 illustrates a DSP System used to encode information during the production of the soundtrack. Speakers Ls 1814, Lb 1818, Rb 1820, Rs 1816, L 1808, C 1810, and R 1812 play sound signals analyzed by an engineer 900. Engineer 900 is seated at the mixing console controls audio signals and positions them in the space using the control device 1802 which would typically be a tablet or mouse. Information from 1802 is taken to the DSP matrix 1822 which positions the sound in the space using the level and time delay calculations described earlier. The engineer observes the effect in real time.

Control data from 1802 is also taken via 1822 to be processed, encoded and recorded on recording system 1806 together with the audio information directly from the mixing console 1804. This creates a file for distribution containing both audio and control information that can be translated into any playback environment.

In an exemplary embodiment, in an encode system as described in FIG. 18, the recording loudspeaker system is set up to a suitable configuration for the space available and the image definitions are calculated for the desired audio images. In this embodiment, the standard 7.1 audio playback positions are chosen. Also, in this configuration the operator 900 can sit in the sweet spot behind the audio control console 1804. The image definitions will be defined in this case as L, C, R, Ls, Rs, Lb, Rb in line with industry standards for 7.1 playback.

Figure 19:
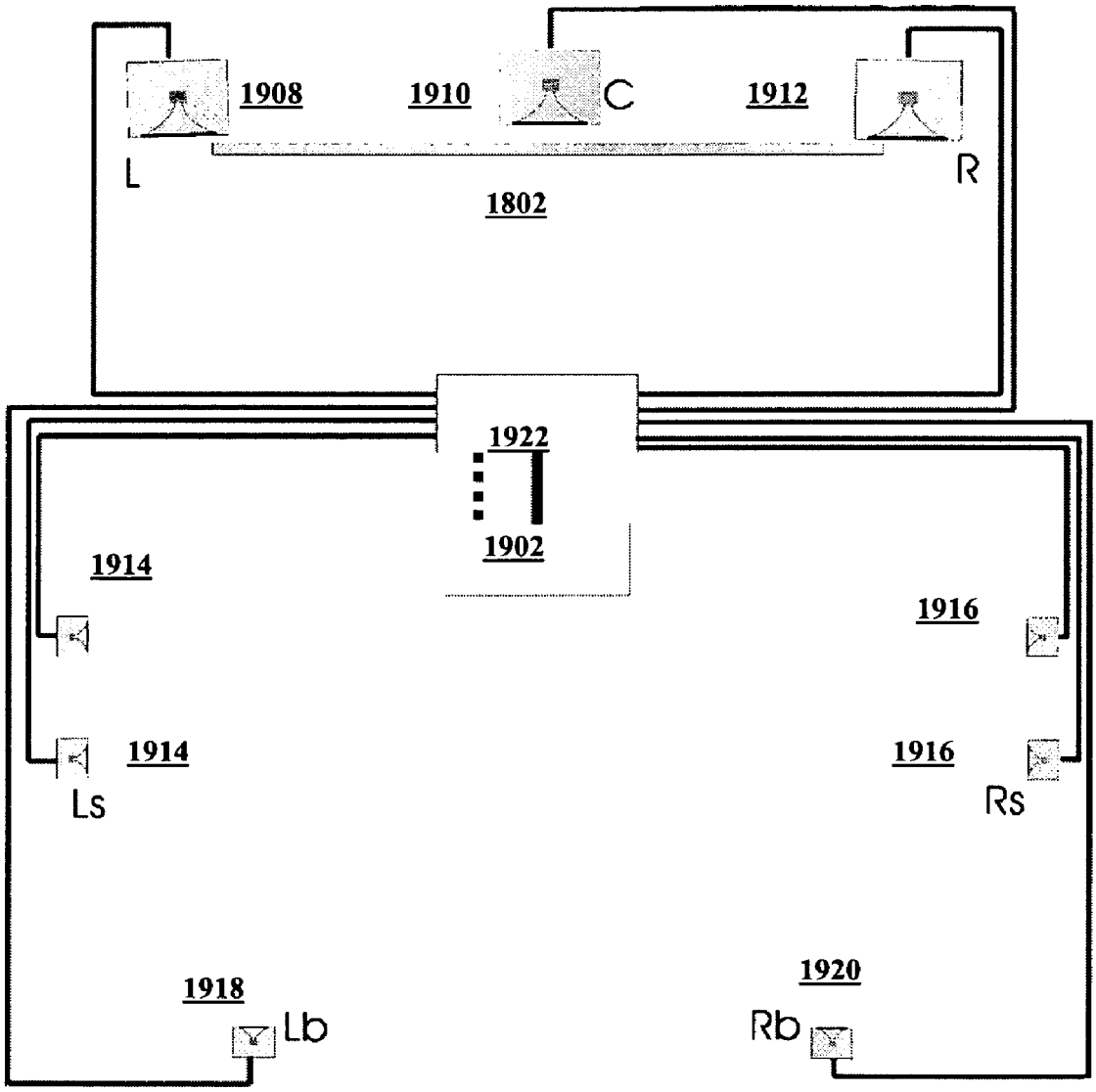
FIG. 19 illustrates a sound playback environment in accordance with certain embodiments of the present invention.

FIG. 19 illustrates a DSP System used to decode information during the production of the soundtrack. Similarly to FIG. 18, the system includes a set of speakers Ls 1914, Lb 1918, Rb 1920, Rs 1916, L 1908, C 1910, and R 1912, which in this case are suited for the playback environment. The figure shows a typical playback environment that is used in accordance with the present embodiments. The playback system 1902 is loaded with the file taken from recorder 1806 and played back through the DSP 1922 which reads the control data and also the audio. The control data is fed into the DSP matrix which has been programmed with the loudspeaker positions for the new space and hence delays and, using the control data, makes the sound the same as it was in the recording space. Movements of sound are processed in the DSP 1822, changing the delays as required by the control data making the sound move in the space.

In an exemplary embodiment, in the playback environment illustrated the relative positions of the loudspeakers are the same but the distances are bigger and there is a requirement for a much larger sweet spot because it is a multi user environment. To overcome the distance that the loudspeakers are apart in the playback loudspeaker system 1908-1920, the audio image in the playback environment is based on image definitions not loudspeakers.

Figure 17:
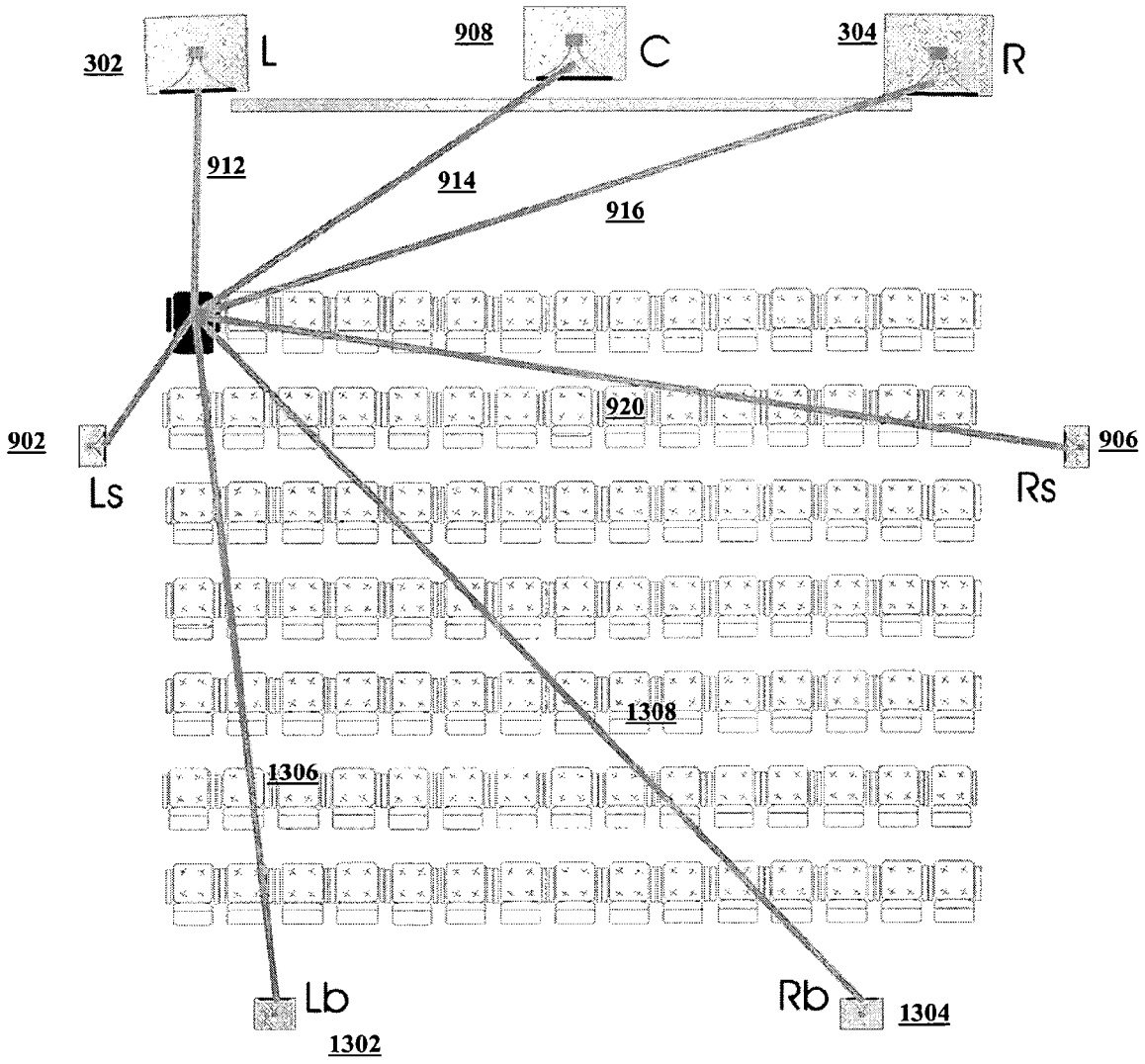
FIG. 17 illustrates sound signal path dispersal used to calculate a left image definition in accordance with certain embodiments of the present invention.

For example, for a listener seated as shown in FIG. 17, in the closest seat to the Left (L) speaker, the time taken for the audio signal to travel from the L speaker is less than it would be for a listener seated elsewhere in the room. Because of the precedence effect, this is defined as the worst seat for any signals emanating from the L speaker other than those creating an image exactly where the speaker is placed. It is, however, possible to feed signals from other audio channels into this speaker but by delaying them so that the sound arrives earlier from another source, the precedence effect will take over and the direction of the sound from the L speaker will be ignored by the listener, but the sound pressure level (SPL) and hence the intelligibility of the sound will be enhanced by the feed from the L speaker.

For the embodiment of FIG. 17, the calculations for the left image definition are based on L+(delta C(Delay c1−Delay 11+10mS))+(delta R(Delay r1.−Delay 11+10mS))+((delta Ls(Delay Is1−Delay 11+10mS))+((delta Rs(Delay Rs1−Delay 11+10mS))

where delta defines a fractional quantity of the signal. Delay c1 is the time taken for a signal to reach the left seat from the C speaker, Delay 11 is the time taken for signal to reach the left seat from the L speaker and Delay r1 is the time taken for the signal to reach the left seat from the R speaker.

In this situation it is assumed that the Left Image Definition is the same as the left loudspeaker. To test the Left Image Definition using this model we get the following signals: left front seat; and left speaker with delayed plus attenuated center and right precedence effect makes this solid left.

Figure 20:
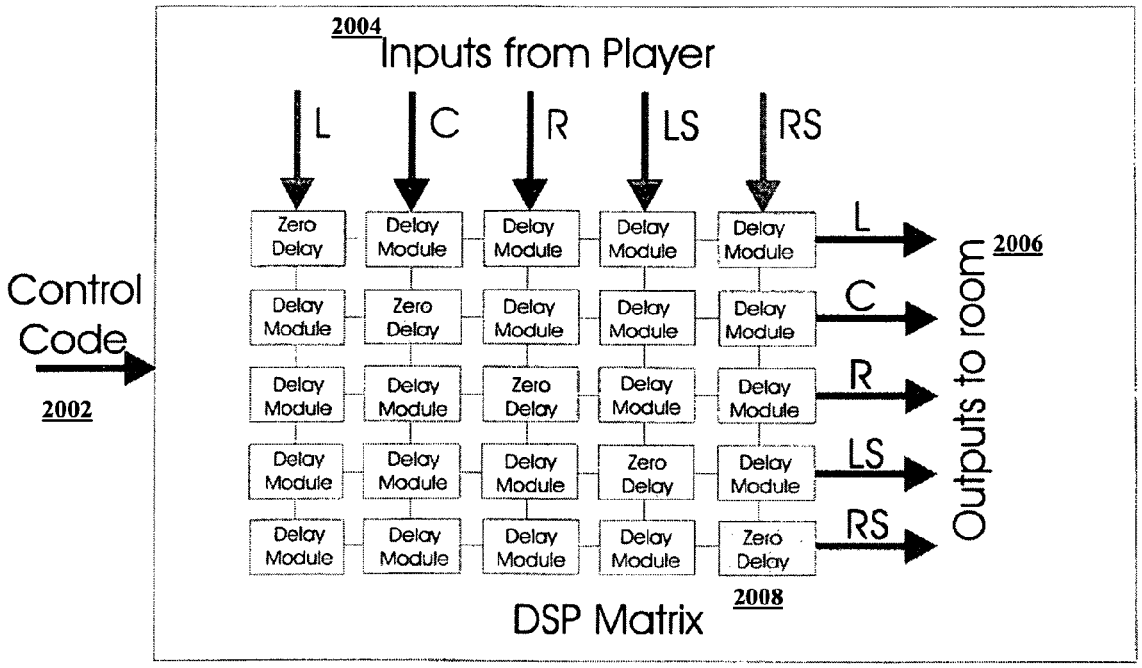
FIG. 20 illustrates a digital signal processing (DSP) matrix environment used in accordance with certain embodiments of the present invention.
Figure 21:
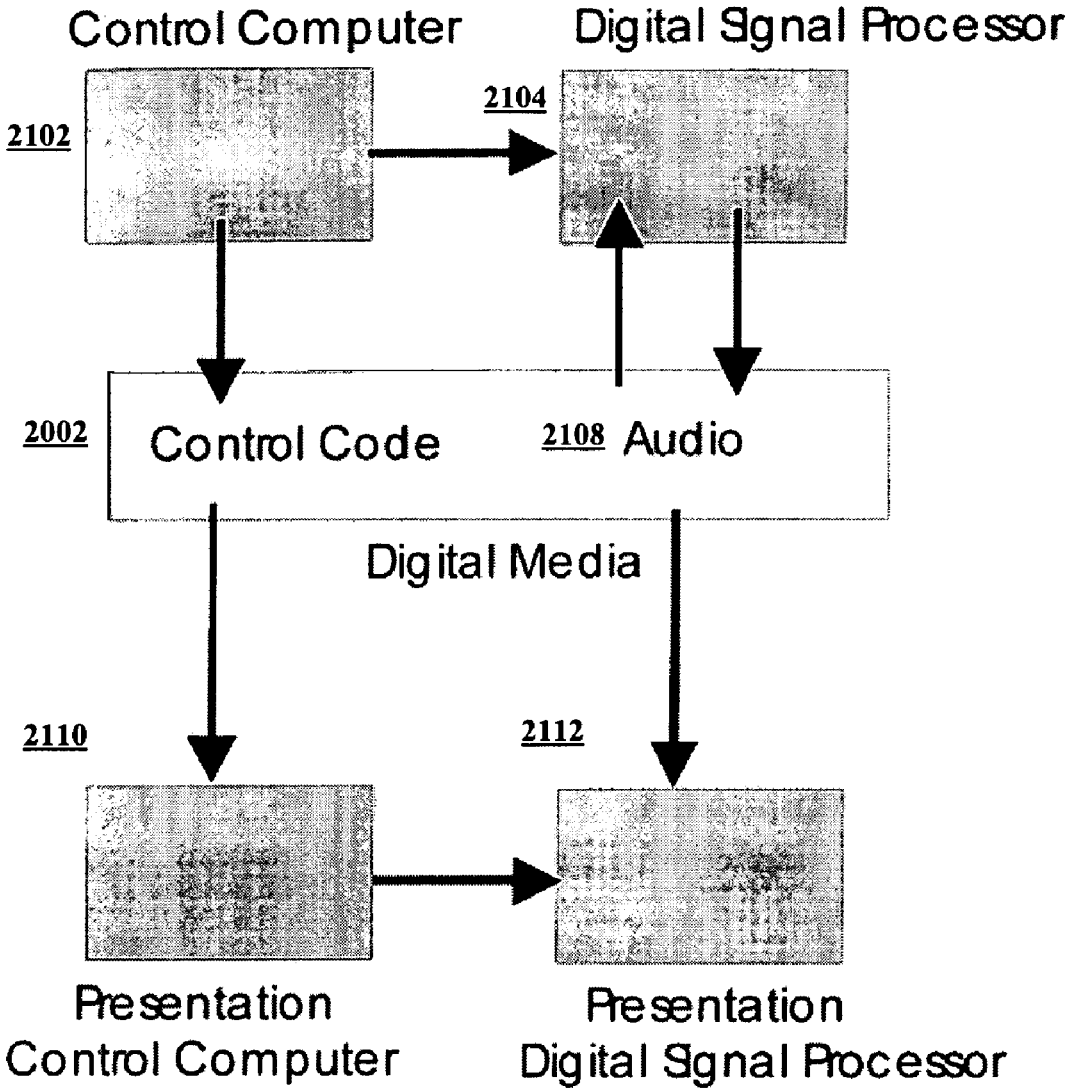
FIG. 21 illustrates a block diagram representation of elements used in the recording and playback modes in accordance with certain embodiments of the present invention.

FIG. 20 illustrates the mapping from the respective inputs from the player 2004, during encoding, to the respective outputs to the room 2006, during decoding. The mapping is performed in response to the control code 2002, calculated in accordance with the present embodiments. FIG. 21 illustrates the processing performed on the encoding (recording) side, namely by control computer 2102 interacting with DSP 2104 (for example, DSP 1822 of FIG. 18), as mapped by the control code 2002 and audio 2108 to the decoding (playback) side, namely presentation control computer 2110 and DSP 2112 (for example, DSP 1922 of FIG. 19).

It should be noted that surround sound formats have been very successful at standardizing the market and educating the consumer. Most purchasers are aware of 5.1 and possibly 6.1 and 7.1, they relate this to the speaker positioning and have a vastly improved listening experience than with stereo where a lack of consumer knowledge tended to lead to extremely dubious speaker positioning.

The need to sit in a suitable viewing position for the screen has created a consumer who is used to listening to relatively good sound in the sweet spot with imaging similar to the original mix. This has created a raised consumer awareness to surround imaging both at home and in a public space. This is increasing pressure on exhibitors to improve the experience in the theater to remain superior to the home experience.

However, there is no need to limit the number of speakers and their position to the delivery medium. Larger spaces need more speakers to create an even sound pressure level (SPL) throughout the space. It is possible to create sub-mixes to the additional loudspeakers using delayed signals from the existing channels.

Digital Cinema potentially offers 16 channels of uncompressed digital audio. There is now no real need to encode the signal to squeeze onto the delivery medium. There may be, however, reasons to encode the information to enable it to be presented consistently in different size venues.

Some solutions to imaging have suggested using the new bandwidth to vastly increase the number of sound sources in the listening area. Hass has shown that without control of the time delays this is an expensive and inaccurate solution due to the precedence effect taking control. While it must be said that a very small number of loudspeakers is only effective in a home theater environment the number of sound sources to create a realistic effect in a large theater is closer to 12 than 1200. Assuming of course that each source is orientated correctly as discussed previously.

Also, as noted with respect to FIGS. 18 and 19, the present embodiments permit the separation of the mix space from the exhibition space. The inventive image definitions allow the mix engineer to create an image in the studio knowing that it will be accurately reproduced in the theater. By means of the present embodiments, the DVD mixes can be pre-encoded as the listening space is similar enough in size for such an effect to work for the vast majority of DVD audiences. The engineer does not need to be concerned with delays and cross-point matrices. The user interface can be a graphical representation of the space and sounds are simply dragged around on a screen with a pen or mouse. Movements can be prerecorded and slaved from timecode or other cues. An automation system can be used to build up events as the mix progresses.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. An audio processing system for increasing intelligibility to a plurality of listeners in a space comprising:

a plurality of loudspeakers; and a digital signal processor configured for:

changing amplitude of an audio signal;

changing the time delay of an audio signal in excess of 10 milliseconds;

summing delayed audio signals and routing to multiple loudspeakers;

defining virtual sound source positions in said space as image definitions;

previewing said image definitions and store their value;

recalling said image definitions and applying to alternative spaces and configurations to provide virtual audio positions that are independent of space dimensions and the loudspeaker position;

moving the perceived sound image in said space, between said image definitions and observe the effect;

creating and storing control data; and recalling said control data and said image definitions and create similar perceived movements of the sound images between said image definitions in a different space; wherein, said image definitions define the positions whereby an audience perceives the sound to come from, independent of the physical position of the loudspeakers; and wherein, said image definitions allow audio movement to be controlled with positional data describing the position relative to the said image definitions with respect to time.

* * * * *